US005499411A

United States Patent [19]

Wong

[11] Patent Number: 5,499,411

[45] Date of Patent: Mar. 19, 1996

[54] SAND POCKET BEACH BLANKET

[76] Inventor: King Wong, 38 Richard Rd., Edison, N.J. 08820

[21] Appl. No.: 408,500

[22] Filed: Mar. 22, 1995

[51] Int. Cl.[6] ..... A47G 9/06

[52] U.S. Cl. ..... 5/417

[58] Field of Search ..... 5/417, 418, 419

[56] References Cited

U.S. PATENT DOCUMENTS

| | | | |
|---|---|---|---|
| D. 317,995 | 7/1991 | Crowley-McGregor | 5/417 |
| 4,227,270 | 10/1980 | Rivera | 5/417 |
| 4,272,575 | 6/1981 | Egigian | 5/417 |
| 4,468,823 | 9/1984 | Tounjian | 5/417 |
| 4,654,906 | 4/1987 | Roberts | 5/417 |
| 4,885,195 | 12/1989 | Change, III | 5/417 |
| 5,072,467 | 12/1991 | Hunt | 5/419 |
| 5,136,738 | 8/1992 | Denson | 5/417 |
| 5,244,278 | 9/1993 | Robitaille | 5/417 |
| 5,406,659 | 4/1995 | Camp | 5/417 |

*Primary Examiner*—Michael J. Milano

[57] ABSTRACT

A blanket for weighted anchoring to a surface. The inventive device includes a blanket web positionable upon a beach surface. A plurality of anchor assemblies are secured to the blanket web and operate to receive sand to anchor the blanket web relative to the beach surface.

2 Claims, 3 Drawing Sheets

SAND POCKET BEACH BLANKET

BACKGROUND OF THE INVENTION

1. Field of the Invention

The present invention relates to blanket structures and more particularly pertains to an sand pocket beach blanket for weighted anchoring to a surface.

2. Description of the Prior Art

The use of blanket structures is known in the prior art. More specifically, blanket structures heretofore devised and utilized are known to consist basically of familiar, expected and obvious structural configurations, notwithstanding the myriad of designs encompassed by the crowded prior art which have been developed for the fulfillment of countless objectives and requirements.

While the prior art blanket structures fulfill their respective, particular objectives and requirements, the prior art does not disclose a sand pocket beach blanket for weighted anchoring to a surface which includes a blanket web positionable upon a beach surface, and a plurality of anchor assemblies secured to the blanket web for receiving sand to anchor the blanket web relative to the beach surface.

In these respects, the sand pocket beach blanket according to the present invention substantially departs from the conventional concepts and designs of the prior art, and in so doing provides an apparatus primarily developed for the purpose of weighted anchoring to a surface.

SUMMARY OF THE INVENTION

In view of the foregoing disadvantages inherent in the known types of blanket structures now present in the prior art, the present invention provides a new sand pocket beach blanket construction wherein the same can be utilized for weighted anchoring to a surface to protect an individual from contact with such surface. As such, the general purpose of the present invention, which will be described subsequently in greater detail, is to provide a new sand pocket beach blanket apparatus and method which has many of the advantages of the blanket structures mentioned heretofore and many novel features that result in a sand pocket beach blanket which is not anticipated, rendered obvious, suggested, or even implied by any of the prior art blanket structures, either alone or in any combination thereof.

To attain this, the present invention generally comprises a blanket for weighted anchoring to a surface. The inventive device includes a blanket web positionable upon a beach surface. A plurality of anchor assemblies are secured to the blanket web and operate to receive sand to anchor the blanket web relative to the beach surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sand pocket beach blanket apparatus and method which has many of the advantages of the blanket structures mentioned heretofore and many novel features that result in a sand pocket beach blanket which is not anticipated, rendered obvious, suggested, or even implied by any of the prior art blanket structures, either alone or in any combination thereof.

It is another object of the present invention to provide a new sand pocket beach blanket which may be easily and efficiently manufactured and marketed.

It is a further object of the present invention to provide a new sand pocket beach blanket which is of a durable and reliable construction.

An even further object of the present invention is to provide a new sand pocket beach blanket which is susceptible of a low cost of manufacture with regard to both materials and labor, and which accordingly is then susceptible of low prices of sale to the consuming public, thereby making such sand pocket beach blankets economically available to the buying public.

Still yet another object of the present invention is to provide a new sand pocket beach blanket which provides in the apparatuses and methods of the prior art some of the advantages thereof, while simultaneously overcoming some of the disadvantages normally associated therewith.

Still another object of the present invention is to provide a new sand pocket beach blanket for weighted anchoring to a surface to protect an individual from contact with such surface.

Yet another object of the present invention is to provide a new sand pocket beach blanket which includes a blanket web positionable upon a beach surface, and a plurality of anchor assemblies secured to the blanket web for receiving sand to anchor the blanket web relative to the beach surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
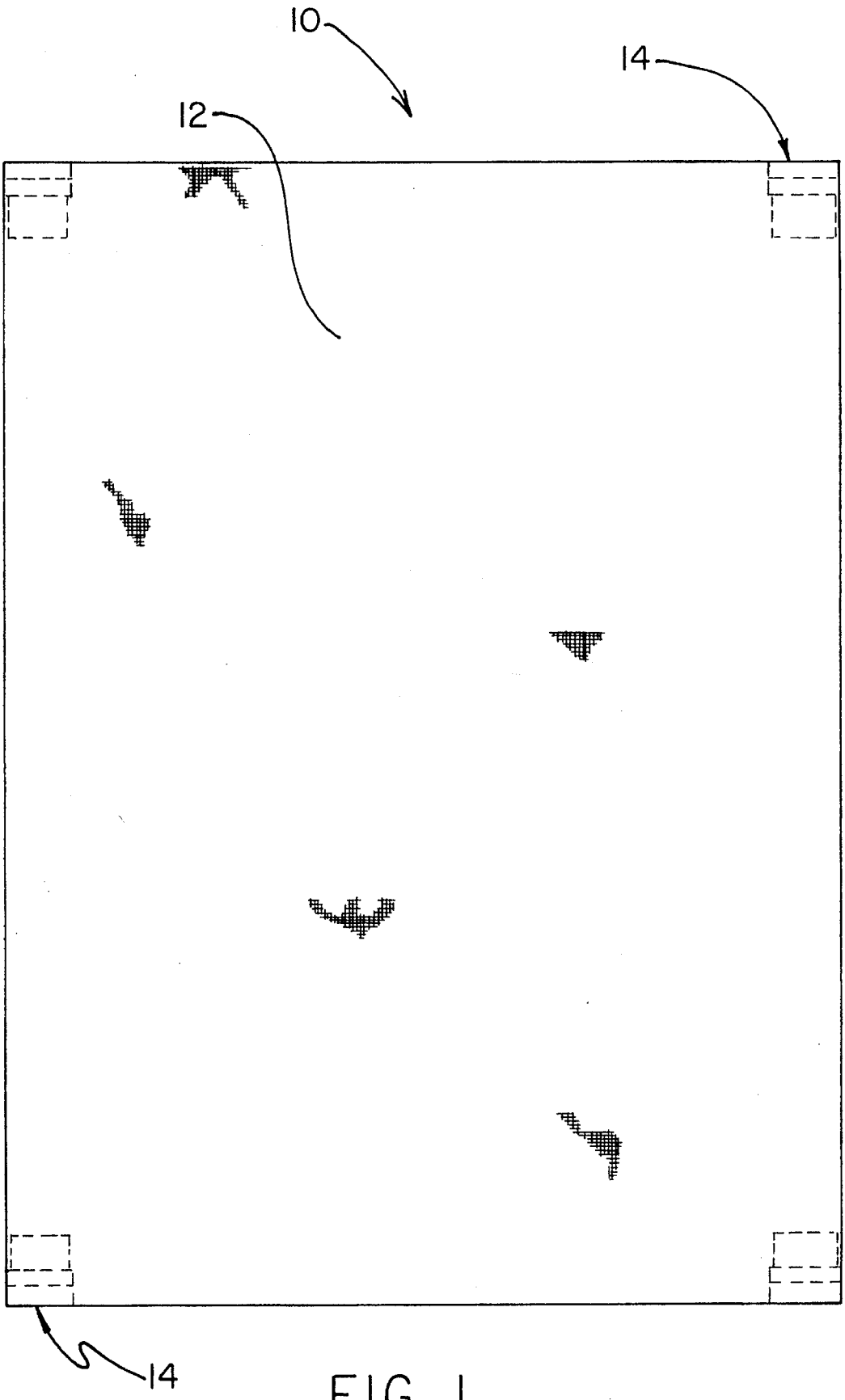
FIG. 1 is a top plan view of a sand pocket beach blanket according to the present invention in use.

With reference now to the drawings, and in particular to FIGS. 1–6 thereof, a new sand pocket beach blanket embodying the principles and concepts of the present invention and generally designated by the reference numeral 10 will be described.

More specifically, it will be noted that the sand pocket beach blanket 10 comprises a blanket web 12 formed of a substantially flexible material and positionable upon a support surface, such as a sandy beach or the like. The blanket web 12 is illustrated in FIG. 1 as being substantially rectangular in shape. However, the blanket web 12 may be of any desired polygonal or geometric shape, such as square, octagonal, or circular for example. A plurality of anchor means 14 are secured to the bottom surface of the blanket web 12 for receiving a granular material such as sand to anchor the blanket web 12 to the support surface upon which it may positioned. By this structure, the blanket web 12 can be selectively anchored relative to a beach to preclude wind or other disturbances from moving the beach blanket 10.

Figure 2:
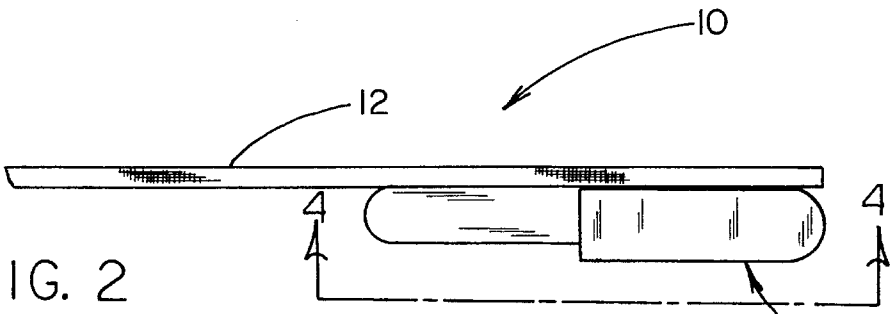
FIG. 2 is a side elevation view of the invention.
Figure 4:
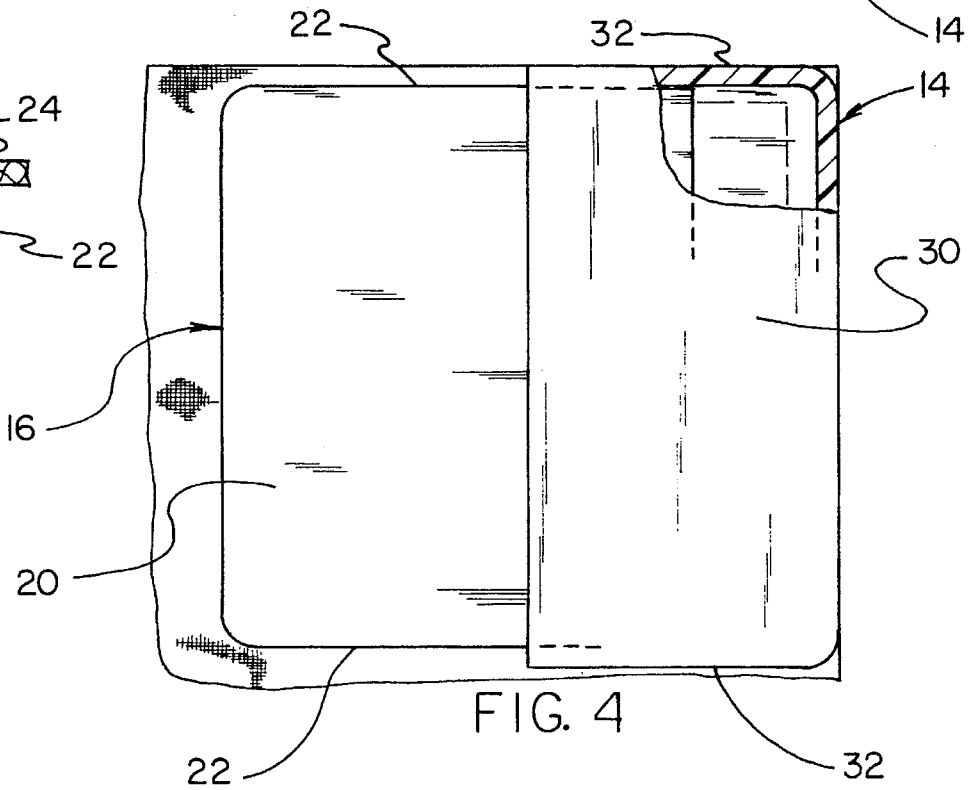
FIG. 4 is a bottom plan view of a portion of the invention as viewed from line 4—4 of FIG. 2.
Figure 3:
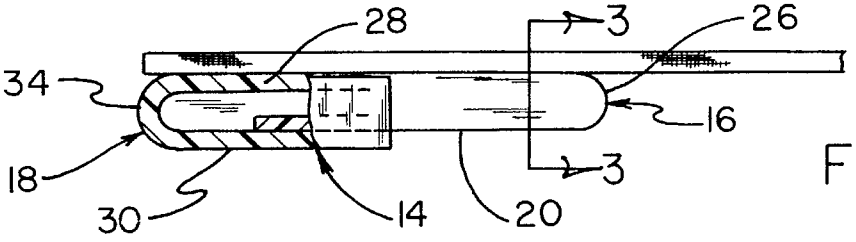
FIG. 3 is a cross sectional view taken along line 3—3 of FIG. 2.
Figure 3:
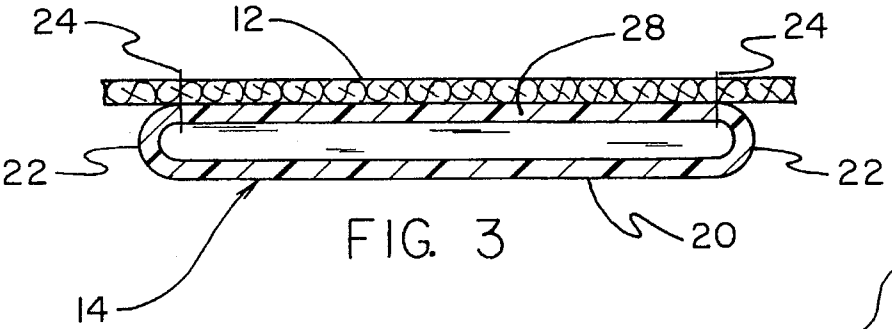

Referring now to FIGS. 2 through 4 wherein the anchor means 14 are illustrated in detail, it can be shown that the anchor means 14 each comprise an interior pocket 16 secured to the bottom surface of the blanket web 12, and an exterior pocket 18 similarly secured to the bottom surface of the blanket web 12 and positioned partially over the interior pocket 16 such that sand or other granular material can be positioned within the exterior pocket 18 and into communication with an interior of the interior pocket 16. In other words, the exterior pocket 18 overlaps the interior pocket 16, with sand or other material being positionable between the overlapping portions of the pockets 16 and 18 to position such sand within the interior of the exterior pocket 18. The interior of the exterior pocket 18 is positioned in communication with the interior of the interior pocket 16 such that the sand may readily flow into the interior pocket to weight the anchor means 14 to preclude lifting or shifting of the blanket web 12.

More specifically and as illustrated in FIGS. 3 and 4, it can be shown that the interior pocket 16 of the anchor means 14 comprises an interior pocket main web 20 having interior pocket lateral webs 22 extending therefrom and coupled to the bottom surface of the blanket web 12 by stitching 24 or other suitable fastening means such as adhesives or heat sealing or the like. An interior pocket end web 26 extends from the interior pocket main web 20 and between the interior pocket lateral webs 22 to couple with the bottom surface of the blanket web 12 and may be secured thereto by stitching 24 or the other alternative means listed above. If desired, a base web 28 can extend between the lateral webs 22 and the end web 26 to permit the anchor means 14 to be molded from a polymeric material or the like. Alternatively, the anchor means 14 can be comprised of a fabric material or other flexible material conventionally known. With continuing reference to FIGS. 3 and 4, it can be shown that the exterior pocket 18 similarly comprises an exterior pocket main web 30 having exterior pocket lateral webs 32 extending laterally from the exterior pocket main web and being coupled to the bottom surface of the blanket web 12 by the stitching 24 or other means. An exterior pocket end web 34 extends from the exterior pocket main web 30 and couples with the bottom surface of the blanket web 12. Alternatively, the exterior pocket end web 34 can be integrally formed as a portion of the base web 28 substantially as shown in FIG. 2 of the drawings. The exterior pocket main web 30 is positioned so as to overlap the interior pocket main web 20 so as to form a closure therebetween. By this structure, sand or other granular material can be positioned between the exterior pocket main web 30 and the interior pocket main web 20 and into an interior of the exterior pocket 18. Sand positioned within the exterior pocket 18 can then flow into an interior of the interior pocket 16 so as to impart a greater weight to the anchor means 14 to secure the device 10 to a surface such as a beach or the like.

Figure 5:
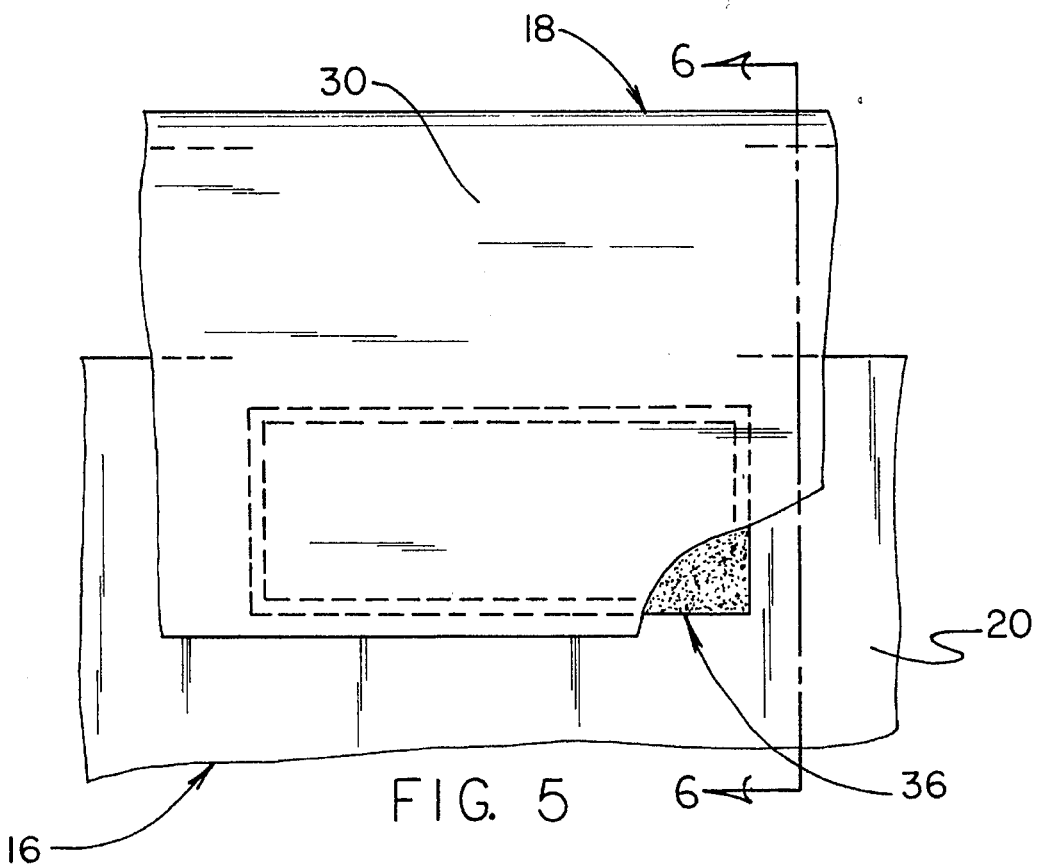
FIG. 5 is a bottom plan view of a portion of the present invention including a fastening means.
Figure 6:
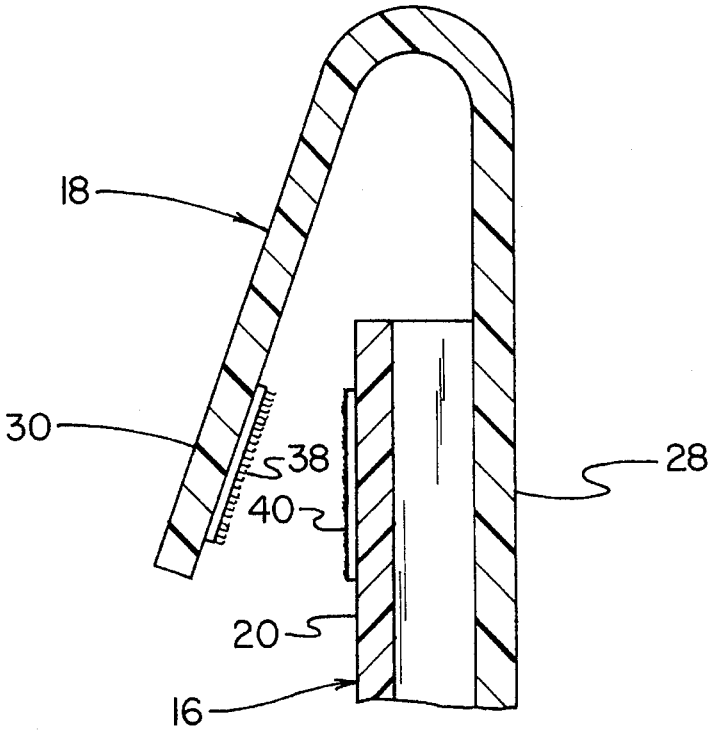
FIG. 6 is a cross sectional view taken along line 6—6 of FIG. 5.

Referring now to FIGS. 5 and 6 of the drawings, it can be shown that the anchor means 14 of the present invention 10 may further comprise a fastening means 36 interposed between the interior pocket main web 20 and the exterior pocket main web 30 for securing the interior pocket main web to the exterior pocket main web. To this end, the fastening means 36 preferably comprises a first portion 38 of a fabric fastening material such as commonly known as "VELCRO" which is secured to an interior surface of the exterior pocket main web 30. A second portion 40 of the fabric fastening material is secured to an exterior surface of the interior pocket web 20 and thus cooperates with the first portion 38 to secure the main webs 20 and 30 together to preclude an egress of granular material or sand from an interior of the anchor means 14.

In use, the sand pocket beach blanket 10 according to the present invention can be easily utilized to separate an individual from a support surface, such as a sandy beach or the like. The anchor means 14 can be selectively filled with a granular material such as readily available sand to impart a greater weight to the anchor means to secure the blanket web 12 relative to the beach surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sand pocket beach blanket comprising:

a blanket web formed of a substantially flexible material and positionable upon a support surface;

a plurality of anchor means secured to the bottom surface of said blanket web for receiving granular material therein to anchor said blanket web to the support surface, each of said anchor means comprising;

an interior pocket secured to the bottom surface of said blanket web, said pocket having an opening only at one end extending across said pocket;

an exterior pocket secured to the bottom surface of said blanket web and partially overlying said interior pocket, said exterior pocket having an opening only at one end extending across said exterior pocket, the openings of said interior pocket and of said exterior pocket facing one another and in communication with one another;

the interior pocket comprising a main web having lateral webs extending therefrom and secured to the bottom surface of said blanket web, said main web extending between the lateral webs and being secured to the bottom surface of said blanket web; and the exterior pocket comprising a main web having lateral webs extending therefrom and being secured to the bottom surface of said blanket web, said main web extending between said lateral webs and being secured to the bottom surface of said blanket web, said main web overlapping the main web of said interior pocket to form a closure therebetween.

2. The sand pocket beach blanket of claim 1 wherein the anchor means further comprises a fastening means interposed between the main webs of said interior and exterior pockets to secure said main webs one to each other.

* * * * *